United States Patent [19]

Gordon

[11] 4,057,245

[45] Nov. 8, 1977

[54] ATHLETE'S LANDING PIT STANDARD PROTECTOR

[76] Inventor: Donald W. Gordon, 2718 Standish, Anaheim, Calif. 92806

[21] Appl. No.: 648,228

[22] Filed: Jan. 12, 1976

[51] Int. Cl.[2] ..... A63K 3/04

[52] U.S. Cl. ..... 272/101; 5/357; 273/55 D

[58] Field of Search ..... 272/100, 101, 102, 103; 273/55 D; 5/345 R, 357; 182/137

[56] References Cited

U.S. PATENT DOCUMENTS

| | | | |
|---|---|---|---|
| 814,654 | 3/1906 | Kee | 5/345 R |
| 2,143,122 | 1/1939 | Dawson | 182/137 |
| 2,945,550 | 7/1960 | Andreasen | 182/137 |
| 3,319,273 | 5/1967 | Solin | 5/357 |
| 3,513,491 | 5/1970 | Gordon | 5/345 R |
| 3,526,911 | 9/1970 | Meyer et al. | 5/345 R |
| 3,782,724 | 1/1974 | Rottman et al. | 273/55 D |

*Primary Examiner*—Jerome Schnall

*Attorney, Agent, or Firm*—Knobbe, Martens, Olson, Hubbard & Bear

[57] ABSTRACT

A protective barrier for surrounding the upright posts used to support the horizontal bar in a pole-vaulting or high jump pit is disclosed. The device comprises a pair of foam members enclosed within a fabric covering positionable on top of the standard used to support the upright posts. The foam elements are connected together by strap members so that, with the release of one strap, one of the foam members may be hinged away from the other to permit adjustment of the position of the standards and posts.

1 Claim, 4 Drawing Figures

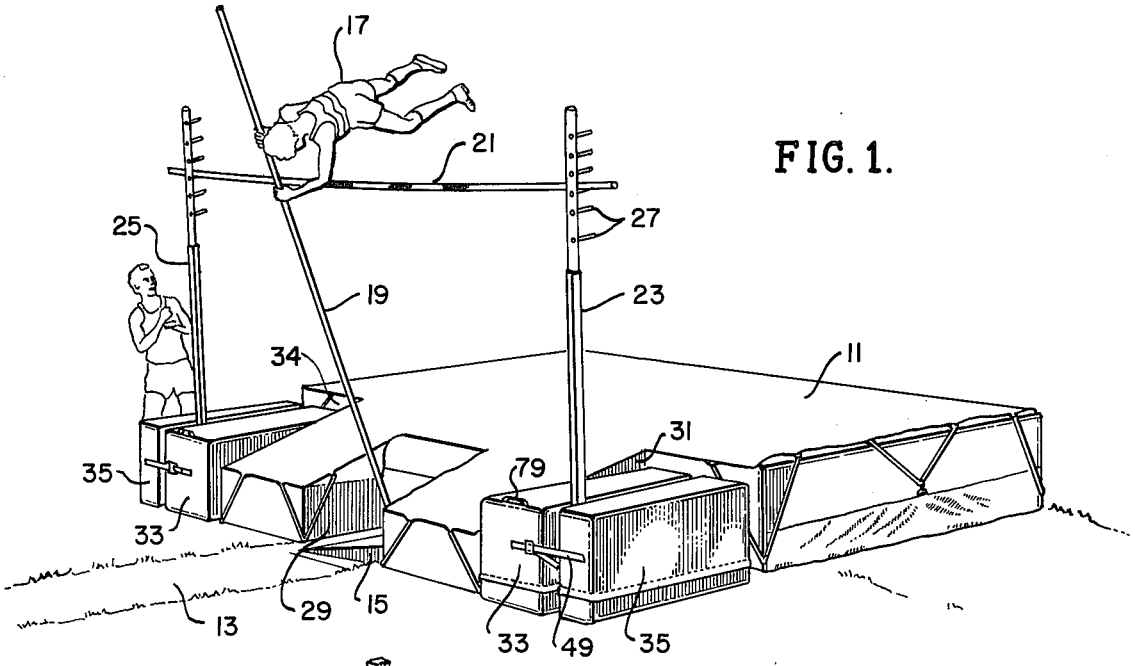
FIG. 1.
FIG. 2.
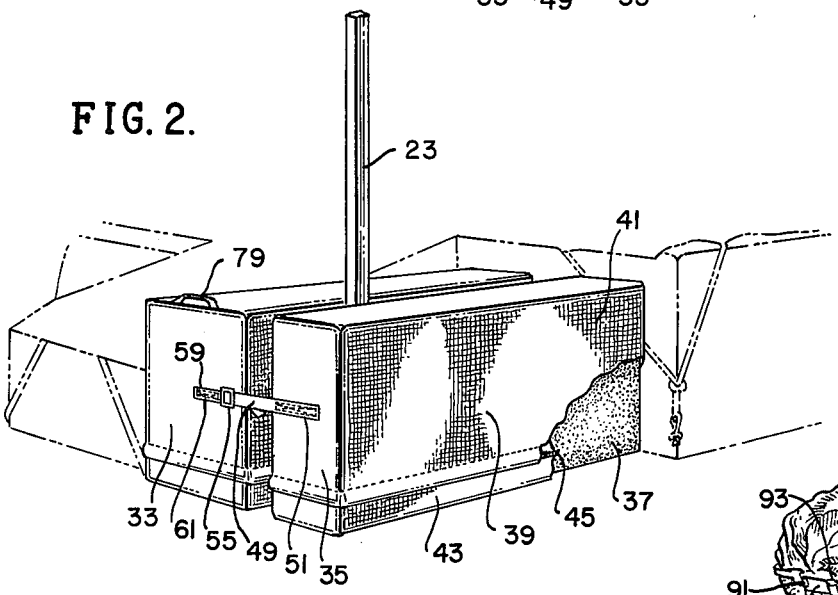
FIG. 4.
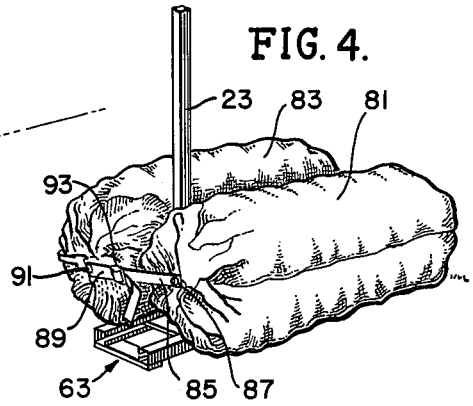
FIG. 3.
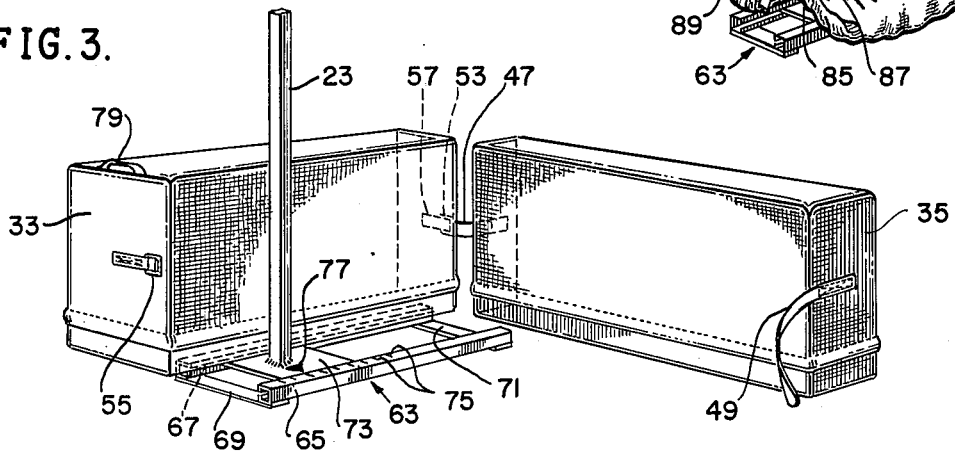

ATHLETE'S LANDING PIT STANDARD PROTECTOR

BACKGROUND OF THE INVENTION

This invention relates to athlete's landing pits and more particularly to a device for protecting athletes from injuries incurred as a result of falling on or running into standards and vertical posts used to support horizontal bars over which the athletes are attempting to jump or pole-vault.

A variety of aboveground portable or semi-portable landing pits used by athletes in conjunction with high jumping or pole-vaulting exist in the prior art. The most widely used devices of this type are constructed in accordance with my prior art U.S. Pat. No. 3,513,491, issued Mar. 13, 1968. That patent describes the construction details for a pit specifically useful for cushioning the fall of a pole-vaulter after his jump. These landing pits are used typically in conjunction with a pair of vertical posts supporting a horizontal bar over which the athlete jumps. Since the vertical posts, particularly when used for pole-vaulting, must be adjustable in a direction toward and away from the front of the landing pit structure so that the horizontal clearance pole may be positioned at different distances behind the plant box, the vertical supporting posts and the standards in which they are supported are typically placed alongside the pit structure. When an athlete has a false jump or for any reason falls to the side of the pit structure, he can seriously injure himself by falling on the vertical supports or the standards used to hold and adjust these vertical supports. There is thus the difficulty of providing sufficient access to the support structure to permit adjustment while protecting the athlete from injury by falling on the structure. In the past it has been common to throw scrap foam in the area around the vertical support structure in an attempt to protect the athletes while still providing access by removing the foam when necessary. This, of course, is a relatively messy operation and, since the foam can be spread out on a field adjacent the landing pit, it may over time provide inadequate protection for the athlete.

SUMMARY OF THE INVENTION

The present invention is designed to alleviate these and other difficulties in the prior art by providing a protective device for a portion of the vertical support and the standard used for positioning this support and allowing adjustment of the support position. The protective device comprises essentially a pair of foam elements each contained within a fabric covering and attached one to the other by end straps which will operate as hinges so that one of the foam elements may be hinged away from the remaining foam element to permit access for adjustment of the standard.

The device is extremely portable and is sufficiently easy to use that it increases the likelihood that it will be positioned in the proper place after each standard adjustment so that athletes will be protected at each jump.

These and other advantages of the present invention are best understood through a reference to the drawings, in which:

FIG. 1 is a perspective view showing a landing pit structure used for pole-vaulters, and showing the standard protector of the present invention;

FIG. 2 is a perspective view of the standard protector portion of FIG. 1, partially broken away to show the construction details of the invention;

FIG. 3 is a perspective view similar to that of FIG. 2 but showing the foam elements of the present invention hinged apart to provide access for adjusting the standard support; and FIG. 4 shows an alternate embodiment of the present invention wherein a pair of fabric covers are used to enclose scrap foam material.

DETAILED DESCRIPTION OF THE PREFERRED EMBODIMENT

Referring initially to FIG. 1, an athlete's landing pit 11 is shown positioned at the end of a runway 13 terminating in a plant box 15. In use, a pole-vaulter 17 runs along the runway 13 and positions the end of a pole 19 in the plant box 15, his momentum carrying him over a horizontal clearance bar 21 which is supported on a pair of vertical supports 23 and 25, typically by plural horizontal pegs 27 extending from the vertical support 23, 25. After clearance of the bar 21, the athlete 17 releases the bar 19 and falls onto the cushioned surface of the landing pit 11.

The details of construction of the landing pit 11 shown in FIG. 1 are described in my copending patent application filed on even date herewith, Ser. No. 651,674. The unique construction of this landing pit 11 protects the athlete 17 from injury after a fall of several feet.

The vertical supports 23 and 25 are typically wood or steel posts which are independently supported on the ground, typically by adjustable standards. The supports 23 and 25, in order to provide for proper adjustment, must be positioned alongside the landing pit 11. In particular, it is common to provide a cutout portion 29 at the front of the pit 11 to surround the plant box 15 and to provide further cutout portions 31 and 34 at the front corners of the pit 11 to provide space for the vertical supports 23, 25 and their adjustable standards.

If the athlete 17 abandons his jump before positioning the pole 19 in the plant box 15, he can run straight down the runway 13 and land against the pit structure 11 to avoid injury. If, however, the athlete 17 has decided to abandon his attempt after positioning the pole 19 in the plant box 15, his inertia may be insufficient to carry him forward over the clearance bar 21 and may carry him instead off to the side toward one of the vertical supports 23 and 25. Since these supports 23 and 25 must be fairly rigidly positioned to provide stable support for the clearance bar 21, they can cause serious damage to the athlete 17 if he lands thereon. In order to avoid such injury, a pair of protective members 33 and 35 are provided by the present invention and surround the base portion of each of the vertical support members 23 and 25. As seen, the members 33 and 35 are positioned on opposite sides of the post and oriented to define a path or joint aligned with the post and extending generally perpendicular to the front edge of the cushion 11 or the horizontal bar 21. These protective members 33 and 35 are typically sized to fit neatly within the front corner openings 31 and 34 of the pit 11. It will be understood, of course, that if the pit 11 is formed simply as a square mat, the members 33 and 35, as well as the vertical supports 23 and 25, will be positioned alongside the square pit.

Referring now to FIGS. 1 through 3, the details of construction of the protective members 33 and 35 will be described. Each of these members, as shown particularly in FIG. 2 on the protective member 35, comprises a large, solid, rectangular foam block 37 surrounded by a fabric cover 39. The fabric cover 39 is preferably constructed in two pieces, an upper cover portion 41 and a lower portion 43. These portions 41 and 43 are tightly fitted over the top and bottom of the foam block member 37 and are attached to one another by a zipper 45. The respective dimensions of the cover 39 are preferably slightly smaller than the dimensions of the foam block 37 so that the block 37 is slightly compressed after the zipper 45 is used to interconnect the upper portion 41 and lower portion 43, resulting in a rectangular block covered by a relatively taut fabric cover 39.

As shown particularly in FIGS. 2 and 3, a pair of straps 47 and 49, typically formed of nonelastic webbed nylon material, are attached at one end, as by sewing at 51, to the block 35. Corresponding buckle members 53 and 55 are attached to a second pair of nonelastic nylon web straps 57 and 59, respectively, which are sewn onto the block 33 as shown at 61. The conbination of these straps 47, 49 and buckles 53, 55 permit the side-by-side attachment of the blocks 33 and 35 to one another.

Referring specifically to FIG. 3, a typical standard 63 for supporting a vertical support member 23 is shown. This standard 63 comprises a pair of horizontal rails 65 and 67 permanently attached to one another by horizontal structural members 69 and 71. The rails 65 and 67 are generally formed as C-channels having horizontally directed openings facing one another. A horizontal support plate 73 fits tightly within the openings in the C-channels 65 and 67 so that lateral movement of the plate 73 is not permitted. Longitudinal movement, that is, movement of the plate 73 along the tracks 65 and 67, is permitted by sliding the plate 73 along the openings in the C-channels 65, 67. It will be understood that the members 23 and 73 are typically steel and are welded together to provide a rigid upright support for the vertical support member 23 from the adjustment plate 73. Similarly, the tracks 65 and 67 are typically made of steel and are each welded to the support members 69 and 71. The standard 63 provides an enlarged horizontal support platform for supporting the vertically extending member 23. Marked distance gradations 75 are typically permanently inscribed on the top of the track 65 and a corresponding position pointer 77 may be imprinted on the support plate 73. Thus, if the standard 63 is placed in a predetermined position relative the plant box 15, the marker 77 and gradations 75 may be used to adjust the position of the vertical member 23 toward and away from the landing pit 11 and the plant box 15. As is well known, such adjustment is typically made for each pole-vaulter in accordance with the height which is being vaulted, so that repeated access to the standard 63 during a track meet is required. The standard protector of the present invention permits the standard, as well as the protector, to be spaced slightly from the landing pit 11 so that when the athlete 17 lands on the pit 11 he does not induce vibration in the vertically extending member 23 which could accidentically dislodge the horizontal bar 21. In prior art landing pits, it was common to place the vertically extending member 23 against the sides of the pit 11 to offer some limited protection to the jumper 17, but this was accomplished only at the expense of possible accidental dislodgement of the bar 21 so that it could not be accurately determined whether the jumper 17 cleared the bar 12.

This repeated access is facilitated by the interconnection of the blocks 33 and 35 using the straps 47, 49 and buckles 53, 55. Thus, as shown in FIG. 3, the front strap 49 may be removed from the front buckle 55 to permit the block 35 to be hinged away from the block 33, using the remaining strap 47, still attached to the buckle 53, as a hinge element. It will be further recognized that when both of the straps 47 and 49 are tightened within the buckles 53, 55 the foam block members 33, 35 will bow slightly around the vertical support member 23 to rigidly maintain the position of the blocks 33 and 35 so that they cannot be easily jarred from their protective position surrounding the vertical member 23 and on top of the standard 63. As shown in FIGS. 1 and 2, the blocks 33 and 35 are preferably sized so that, when attached one to the other, they are larger in all horizontal directions than the standard 63 so that the standard 63 is entirely covered by the assembled structure.

It will be recognized that the blocks 33 and 35 are easily transportable, and handles such as the nylon web handle 79 may be included to facilitate such transportation.

Referring now to FIG. 4, an alternate construction of the present invention is shown. In this embodiment, rather than using foam block, 37 enclosed within tight fitting fabric covers 39, scrap foam is used to fill a pair of fabric bags 81 and 83, typically constructed of semi-porous nylon web material. A nylon web strap 85 is connected, as by a bolt 87 passing through grommets in the top of the bag 81, and a similar strap 89 is attached by a similar bolt 91 to the top of the bag 83. The bolts 87 and 91 thus serve to connect the straps 85 and 89 and as a closure for the bags 81 and 83 by passing through multiple grommets. The strap 89 is rigidly connected to a buckle 93 for removable attachment to the strap 85. A similar strap and buckle combination is attached to the bottom of each of the bags 81 and 83 (not shown) to operate as the second strap member for hinged separation and interconnection of the bags 81 and 83 in a manner similar to that used for the embodiment of FIGS. 1 through 3. As in the prior embodiment, the bags 81 and 83 are large enough to completely cover the standard 63 and to surround the base portion of the vertical member 23 to protect athletes from collisions with these elements.

In summary, it will be recognized that each of the embodiments of the present invention includes a pair of fabric enclosures housing relatively soft material such as foam and incorporating attachment members at each end to permit the blocks to be attached to one another surrounding the vertical member 23 used by a pole-vaulter. At least one of the attachment members is detachable to permit the remaining attachment member to operate as a hinge to provide removal of one of the fabric covered members from the standard 63 to facilitate adjustment thereof.

What is claimed is:

1. A landing pit for use by pole-vaulters, comprising:
a soft landing cushion;
a pair of standards positioned adjacent opposite sides of said landing cushion;
a pair of vertical posts supported by said standards;
a clearance bar horizontally extending between said vertical posts;
track means on said standards for permitting movement of said posts relative to said standards in a direction perpendicular to said clearance bar;

cushion members separate from said landing cushion positioned adjacent each of said pair of vertical posts, said cushion members completely overlapping said pair of standards, each of said cushion members comprising a pair of elongated members, one on each side of each post with the direction of elongation of each of said separate members being perpendicular to said clearance bar, said landing cushion having cut-out portions at its front corners defining spaces in which said standards and said cushion members are positioned and with the adjacent elongated sides of said members defining a slot overlying said track means; and fastener means for holding said elongated cushion members against each of said posts, said fastener means being readily detachable to permit one of said elongated members to be easily moved for access to said standards and movement of said posts relative to said landing cushion and said cushion members along said track means.

* * * * *